US007172183B1

(12) United States Patent
Yang

(10) Patent No.: US 7,172,183 B1
(45) Date of Patent: Feb. 6, 2007

(54) HAND CLAMP

(76) Inventor: Chung Cheng Yang, No. 33, Lane 60, Guanjen Road, Dali City, Taichung Hsien 41278 (TW)

( * ) Notice: Subject to any disclaimer, the term of this patent is extended or adjusted under 35 U.S.C. 154(b) by 0 days.

(21) Appl. No.: 11/370,437

(22) Filed: Mar. 8, 2006

(51) Int. Cl.
*B25B 5/02* (2006.01)

(52) U.S. Cl. ..... 269/6; 269/3

(58) Field of Classification Search ..... 269/6, 269/3, 166–171.5; 222/325–327; 81/487
See application file for complete search history.

(56) References Cited

U.S. PATENT DOCUMENTS 5,217,213 A 6/1993 Lii
5,853,168 A * 12/1998 Drake ..... 269/6
6,648,315 B1 11/2003 Lee
6,655,670 B1 * 12/2003 Liou ..... 269/6
6,929,253 B2 * 8/2005 Marks ..... 269/6
7,017,894 B1 * 3/2006 Lin ..... 269/6
2006/0226588 A1 * 10/2006 Khachatoorian et al. ..... 269/6

* cited by examiner

*Primary Examiner*—Lee D. Wilson
(74) *Attorney, Agent, or Firm*—Charles E. Baxley

(57) ABSTRACT

A hand clamp includes a housing having a handle for being held by a hand of a user, a piston rod slidably received in the housing, a driving lever engaged in the housing and having an opening for slidably receiving the piston rod and biased to grip the piston rod when the driving lever is tilted relative to the piston rod. A trigger is pivotally attached to the housing and has a driving shaft for tilting the driving lever to move the piston rod step by step. A braking lever is slidably engaged on the piston rod for gripping the piston rod when the braking lever is tilted relative to the piston rod. A hand grip is pivotally coupled to the handle and has an actuating end for actuating the braking lever to release the piston rod.

17 Claims, 7 Drawing Sheets

HAND CLAMP

BACKGROUND OF THE INVENTION

1. Field of the Invention

The present invention relates to a hand clamp, and more particularly to a hand clamp having an auxiliary hand grip for actuating and releasing a braking lever and for allowing the hand clamp to be easily operated with a single hand of a user.

2. Description of the Prior Art

Various kinds of typical hand clamps or C-clamps or clamping devices have been developed and comprise a piston rod slidably received in a grip body and including a jaw member movable toward and away from a fixed jaw that is solidly attached or coupled to the grip body for selectively grasping or gripping one or more work pieces between the jaw member and the fixed jaw.

For example, U.S. Pat. No. 5,217,213 to Lii discloses one of the typical quick release C-clamp including two pawls pivotally disposed in a grip and biased to engage with a rack that is slidably engaged in the grip. In operation, the user uses his one hand grasp the grip and actuate a handle to move the rack forwardly step by step. For releasing the rack from the pawls, the user has to use the other hand to rotate the rack relative to the handle and may not easily operate the C-clamp with one hand.

U.S. Pat. No. 6,648,315 to Lee discloses another typical clamping device including a catch plate and a release panel slidably engaged onto a piston rod and biased to be released and engaged onto the rod, a hand grip pivotally secured to a housing, and a pawl rotatably secured to the housing and engaged between the hand grip and the catch plate to tilt the catch plate relative to the piston rod, and a knob also rotatably secured to the housing and engaged between the hand grip and the release panel for releasing the release panel relative to the piston rod. However, the knob and the pawl may not be easily or effectively operated by the user.

The present invention has arisen to mitigate and/or obviate the afore-described disadvantages of the conventional hand clamps or clamping devices.

SUMMARY OF THE INVENTION

The primary objective of the present invention is to provide a hand clamp including an auxiliary hand grip for actuating and releasing a braking lever and for allowing the hand clamp to be easily operated with a single hand of a user.

In accordance with one aspect of the invention, there is provided a hand clamp comprising a housing including a downwardly extending handle for being held by a hand of a user, and including a channel formed in the housing, a piston rod slidably received in the channel of the housing and movable forwardly and rearwardly relative to the housing, a driving lever engaged in the housing and including an opening for slidably receiving the piston rod when the driving lever is perpendicular to the piston rod, and for selectively engaging and gripping the piston rod when the driving lever is tilted relative to the piston rod, a first biasing device for biasing the driving lever relative to the housing and for forcing the driving lever to be perpendicular to the piston rod, a trigger pivotally attached to the housing, a driving shaft attached to the trigger and moved in concert with the trigger, for tilting the driving lever relative to the piston rod against the first biasing device, and for allowing the piston rod to be moved relative to the housing by the trigger and the driving shaft step by step when the trigger is cyclically pulled and released by the user, a braking lever engaged in the housing and including an opening for slidably receiving the piston rod when the braking lever is perpendicular to the piston rod, and for selectively engaging and gripping the piston rod when the braking lever is tilted relative to the piston rod, a second biasing device for biasing the braking lever relative to the housing and for forcing and tilting the braking lever to grip and brake the piston rod to the housing and to prevent the piston rod from sliding relative to the braking lever and the housing, and a hand grip pivotally coupled to the handle, and including an actuating end engage with the braking lever to selectively force and erect the braking lever against the second biasing device to a position perpendicular to the piston rod, and for selectively releasing the piston rod from the braking lever, the trigger and the hand grip being operatable with the hand of the user that hold the handle of the housing.

The housing includes a partition for separating a hollow interior of the housing into a rear chamber and a front chamber, the driving lever is received in the front chamber of the housing, and the braking lever is received in the rear chamber of the housing. The hand grip includes a lower end pivotally coupled to the handle with a pivot axle, and includes the actuating end provided on an upper portion and engaged into the rear chamber of the housing for engaging with the braking lever.

The handle includes a recess communicating with the rear chamber of the housing for receiving the hand grip and for allowing the actuating end of the hand grip to be extended and engaged into the rear chamber of the housing. The housing includes at least one side cap attached to one side of the housing for enclosing the rear and the front chambers of the housing.

The first biasing device includes a spring member received in the front chamber of the housing and engaged between the driving lever and the partition of the housing for biasing the driving lever relative to the housing. The second biasing device includes a spring member received in the rear chamber of the housing and engaged between the braking lever and the housing for biasing and tilting the braking lever relative to the housing.

The spring member of the second biasing device includes an opening for slidably receiving the piston rod. The spring member of the second biasing device includes an anchoring blade engaged with the housing and a biasing blade engaged with the braking lever.

The trigger includes a rounded upper end extended into the front chamber of the housing and pivotally engaged with the housing. The housing includes an upwardly extended fixed jaw for engaging with a work piece, and a gripping head attached to the fixed jaw for safely engaging with the work piece.

The piston rod includes a follower attached onto the piston rod, follower includes a groove for receiving the piston rod and includes an orifice communicating with the groove of the follower for receiving a fastener, the fastener detachably secures the follower to the piston rod. The piston rod includes a front hole and a rear hole for selectively engaging with the fastener.

A stop pin is selectively attached to either the front hole or the rear hole of the piston rod for engaging with the housing and for limiting the piston rod to slide relative to the housing and for preventing the piston rod from being disengaged from the housing. The follower includes a jaw member for engaging with a work piece, and a gripping head attached to the jaw member for safely engaging with the work piece.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
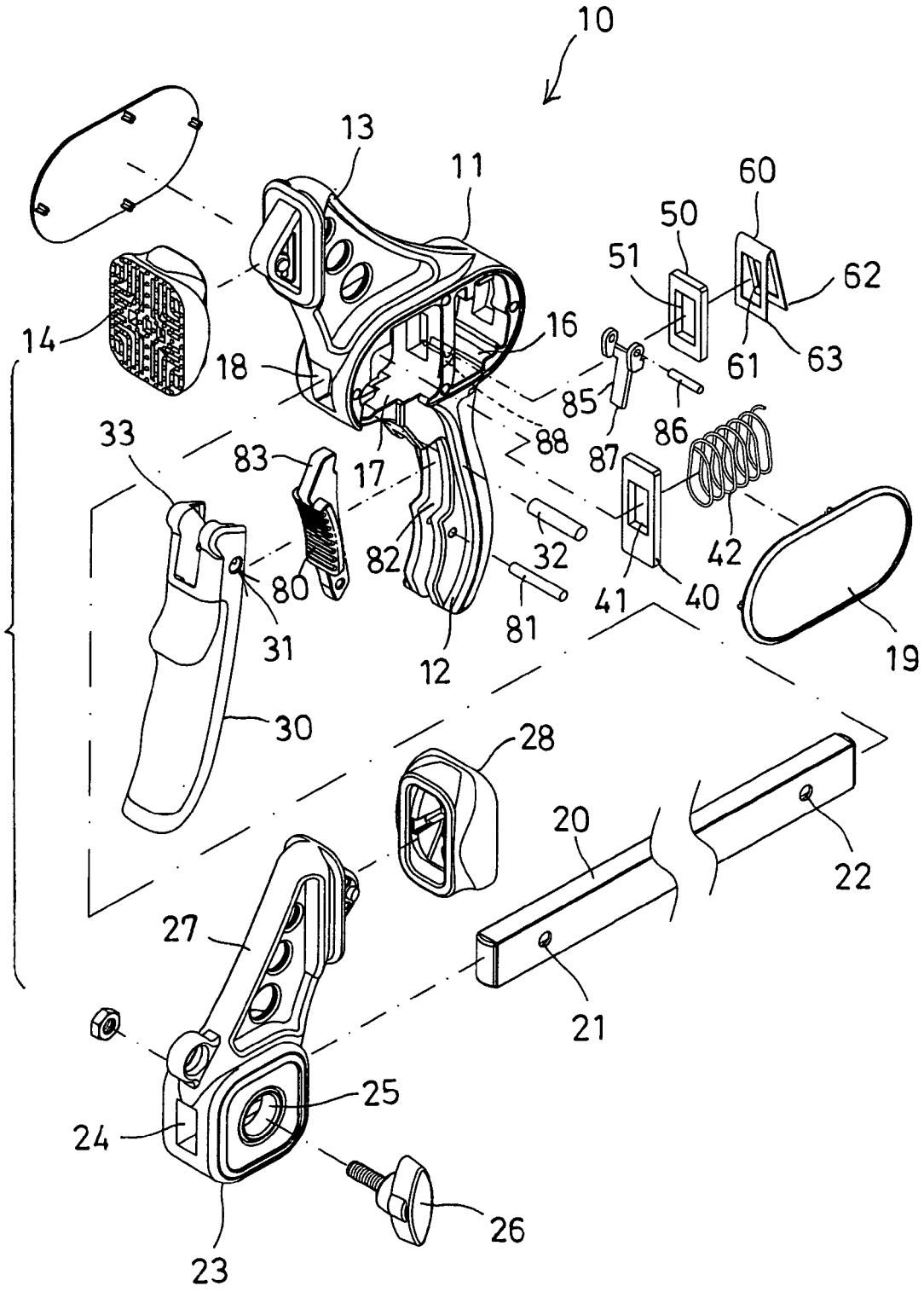
FIG. 1 is an exploded view of a hand clamp in accordance with the present invention.
Figure 2:
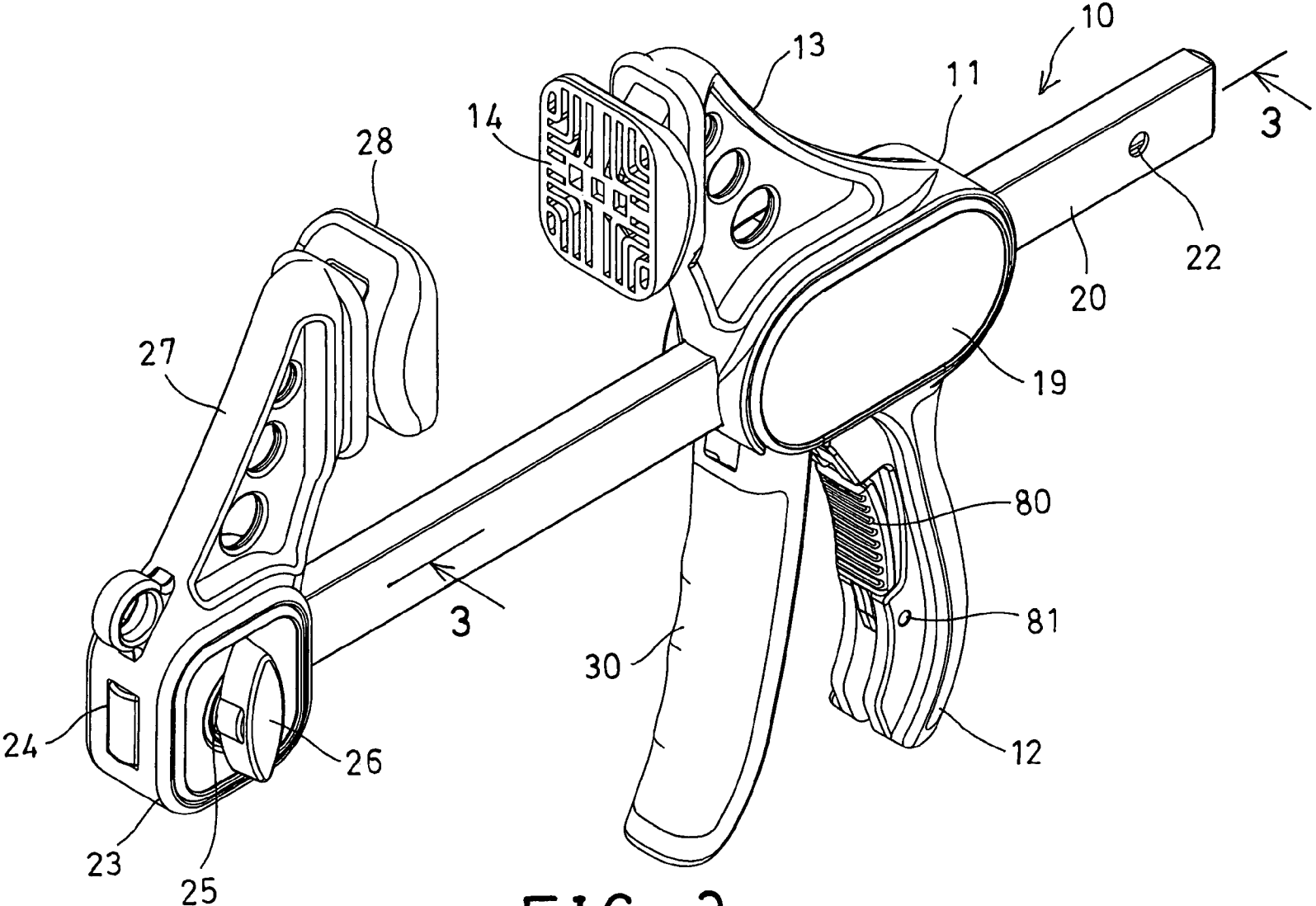
FIG. 2 is a perspective view of the hand clamp.

Referring to the drawings, and initially to FIGS. 1–4, a hand clamp 10 in accordance with the present invention comprises a grip body or housing 11 including a handle 12 extended downwardly therefrom for being held or grasped by the user, and a fixed jaw 13 extended from the housing 11, such as extended upwardly from the housing 11 for contacting or engaging with a work piece 90 (FIGS. 4, 6, 9), it is preferable that a soft or resilient gripping head 14 is attached to the fixed jaw 13 for softly or resiliently and safely contacting or engaging with the work piece 90.

The housing 11 includes a hollow interior, and a partition 15 disposed or engaged in the hollow interior of the housing 11 for separating the hollow interior of the housing 11 into two chambers 16, 17, such as a rear chamber 16 and a front chamber 17. The housing 11 includes a longitudinal channel 18 formed therein and formed through the partition 15 and communicating with the rear and the front chambers 16, 17 thereof for slidably receiving a piston rod 20 therein, and for allowing the piston rod 20 to be moved forwardly and rearwardly relative to the housing 11. One or two side caps 19 may be attached to either or both of the sides of the housing 11 for enclosing the chambers 16, 17 of the housing 11.

The piston rod 20 includes a front hole 21 and a rear hole 22 formed therein for selectively attaching or securing a follower 23. For example, the follower 23 includes a groove 24 formed therein for receiving either of the ends of the piston rod 20, and includes an orifice 25 laterally formed therein and communicating with the groove 24 of the follower 23 for receiving a fastener 26 which may be threaded to either of the front hole 21 or the rear hole 22 of the piston rod 20 and to detachably secure the follower 23 to either of the ends of the piston rod 20.

Figure 9:
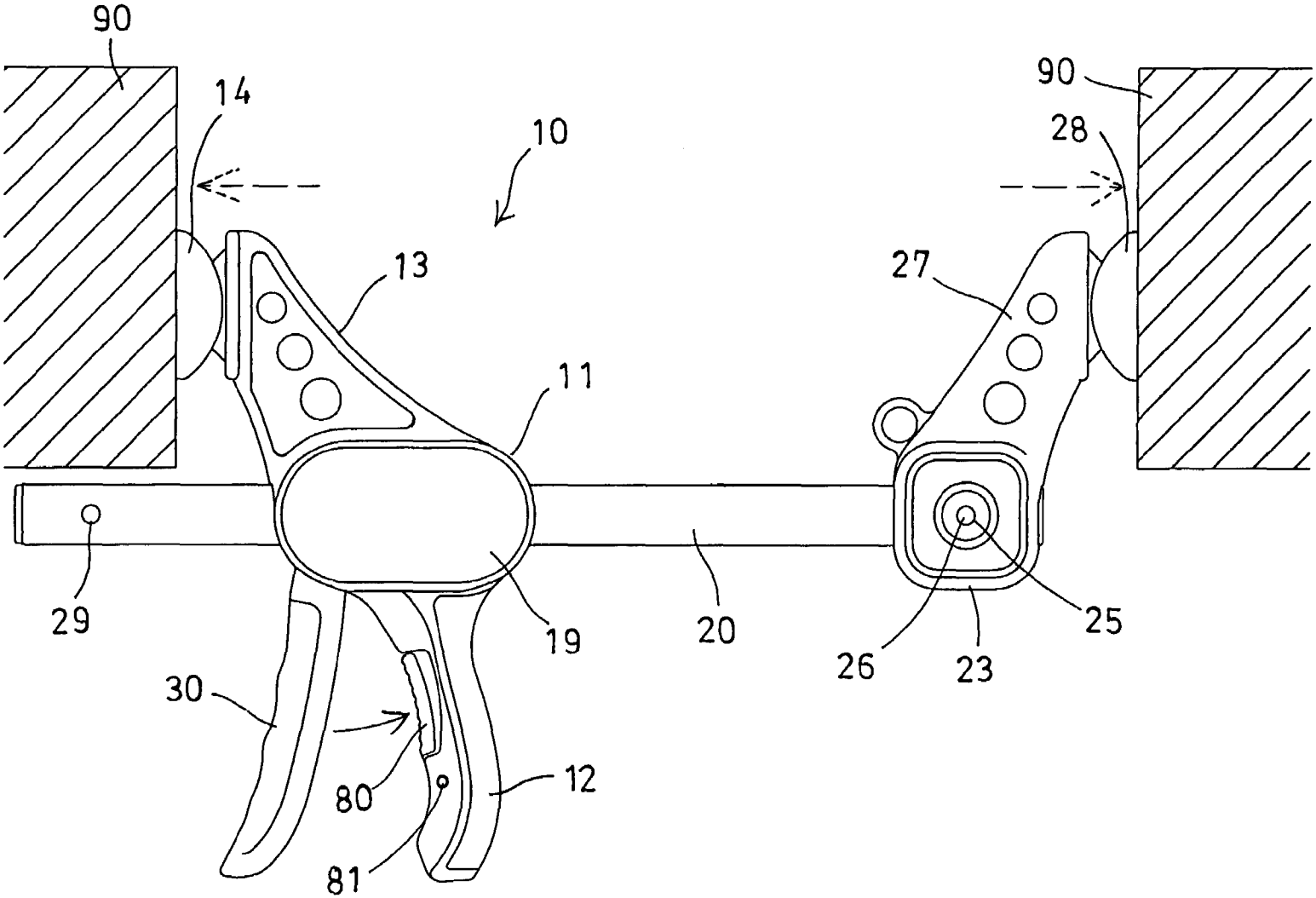
FIG. 9 is a side plan schematic view of the hand clamp as shown in FIG. 8.

The follower 23 includes a jaw member 27 extended therefrom, such as extended upwardly from the follower 23 for contacting or engaging with the work piece 90 (FIGS. 4, 6, 9), it is also preferable that a soft or resilient gripping head 28 is attached to the jaw member 27 for softly or resiliently and safely contacting or engaging with the work piece 90. The jaw member 27 is movable together with the piston rod 20 for being moved toward or away from the fixed jaw 13 and for clamping the work piece 90 between the fixed jaw 13 and the jaw member 27 (FIGS. 4, 6) or for forcing the fixed jaw 13 and the jaw member 27 onto the work pieces 90 (FIG. 9).

Figure 8:
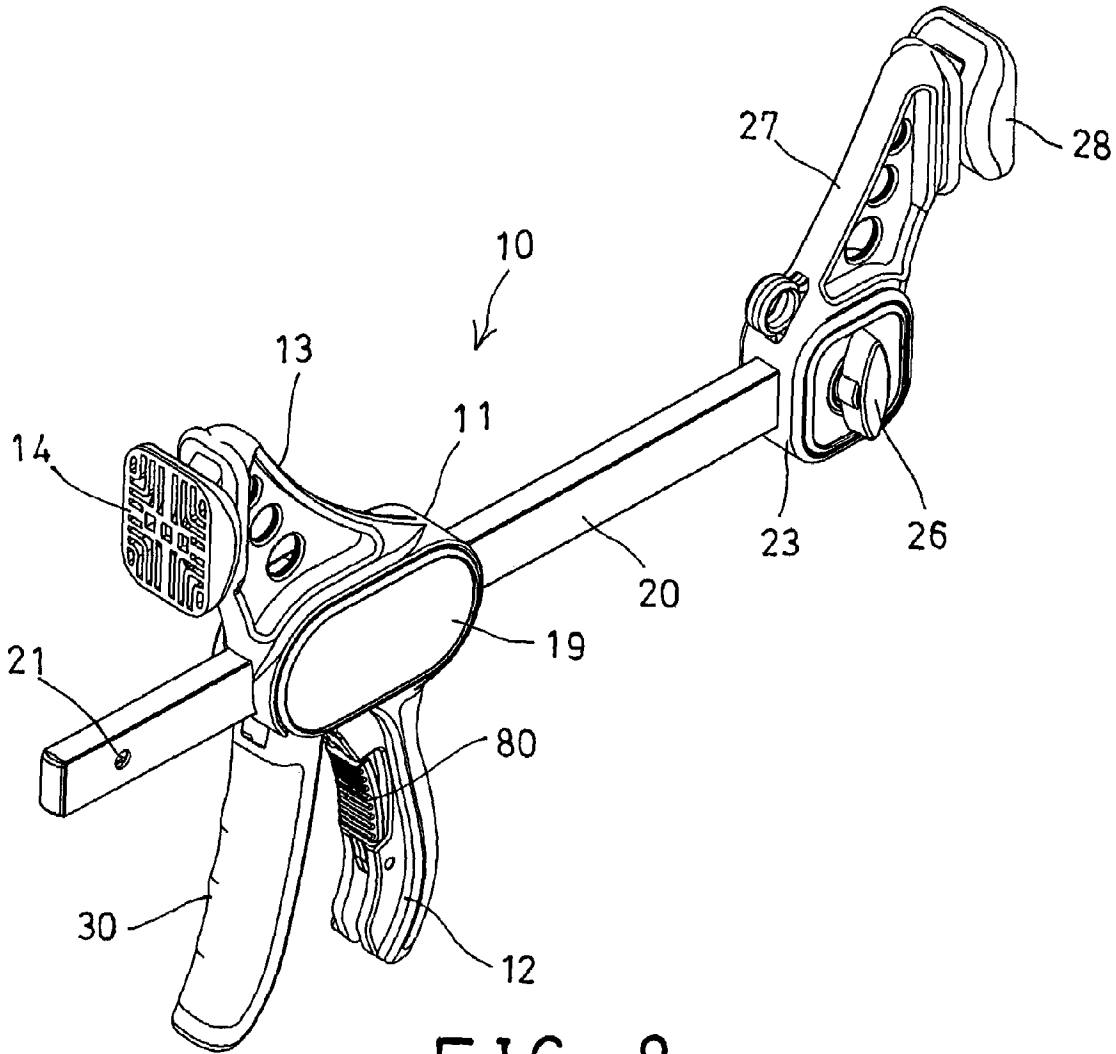
FIG. 8 is a perspective view illustrating the other arrangement of the hand clamp.

A stop pin 29 may be selectively attached or engaged into either of the front hole 21 or the rear hole 22 of the piston rod 20, as shown in FIGS. 3, 4, 6 and 9, for engaging with the housing 11 and for limiting the piston rod 20 to slide relative to the housing 11 and for preventing the piston rod 20 from being disengaged from the housing 11. As described above, the follower 23 may be attached to either the front portion of the piston rod 20 (FIGS. 2–4, 6) or the rear portion of the piston rod 20 (FIGS. 8–9), and the stop pin 29 may thus be selectively attached to the rear portion or the front portion of the piston rod 20.

Figure 3:
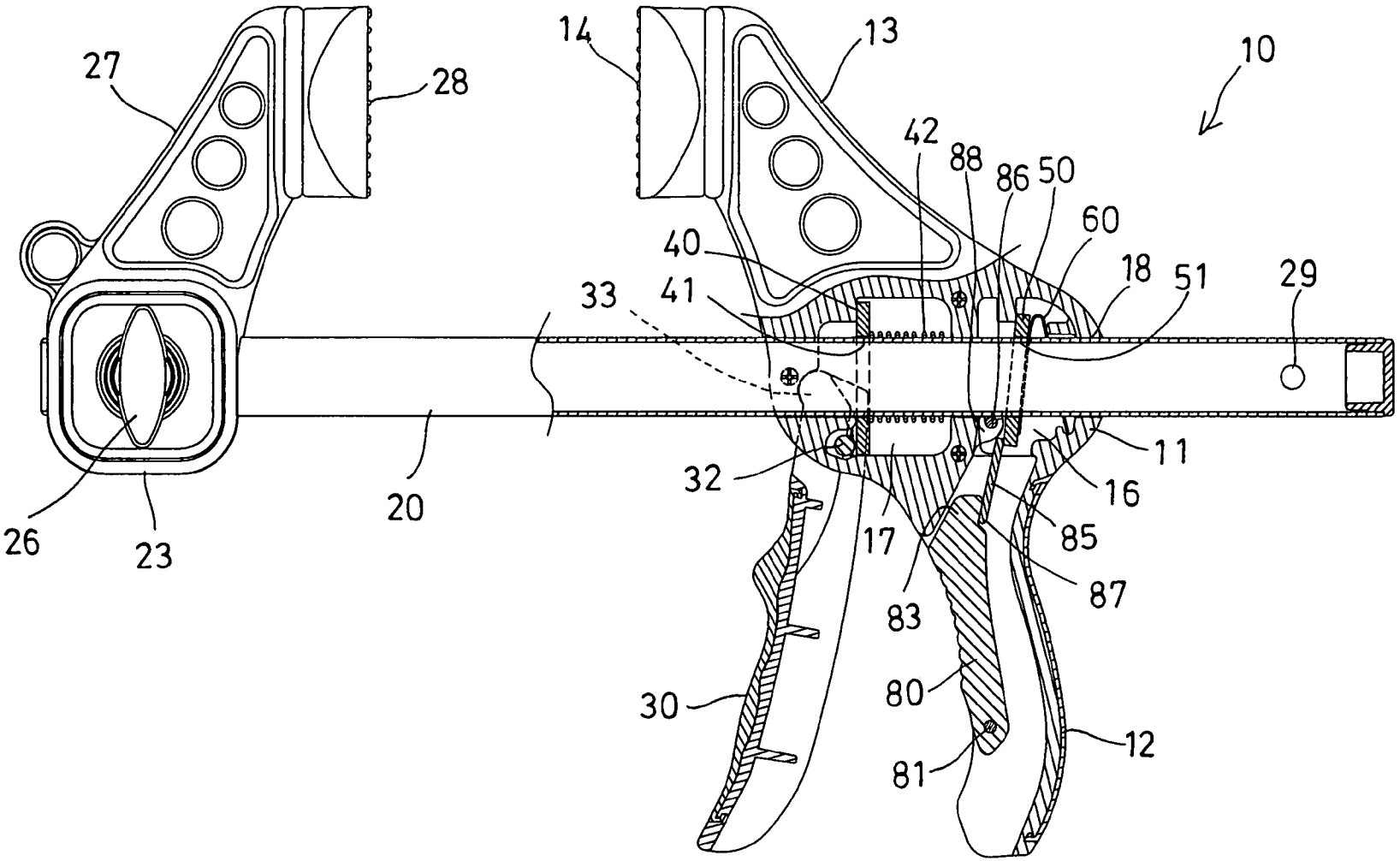
FIG. 3 is a partial cross sectional view of the hand clamp, taken along lines 3—3 of FIG. 2.
Figure 4:
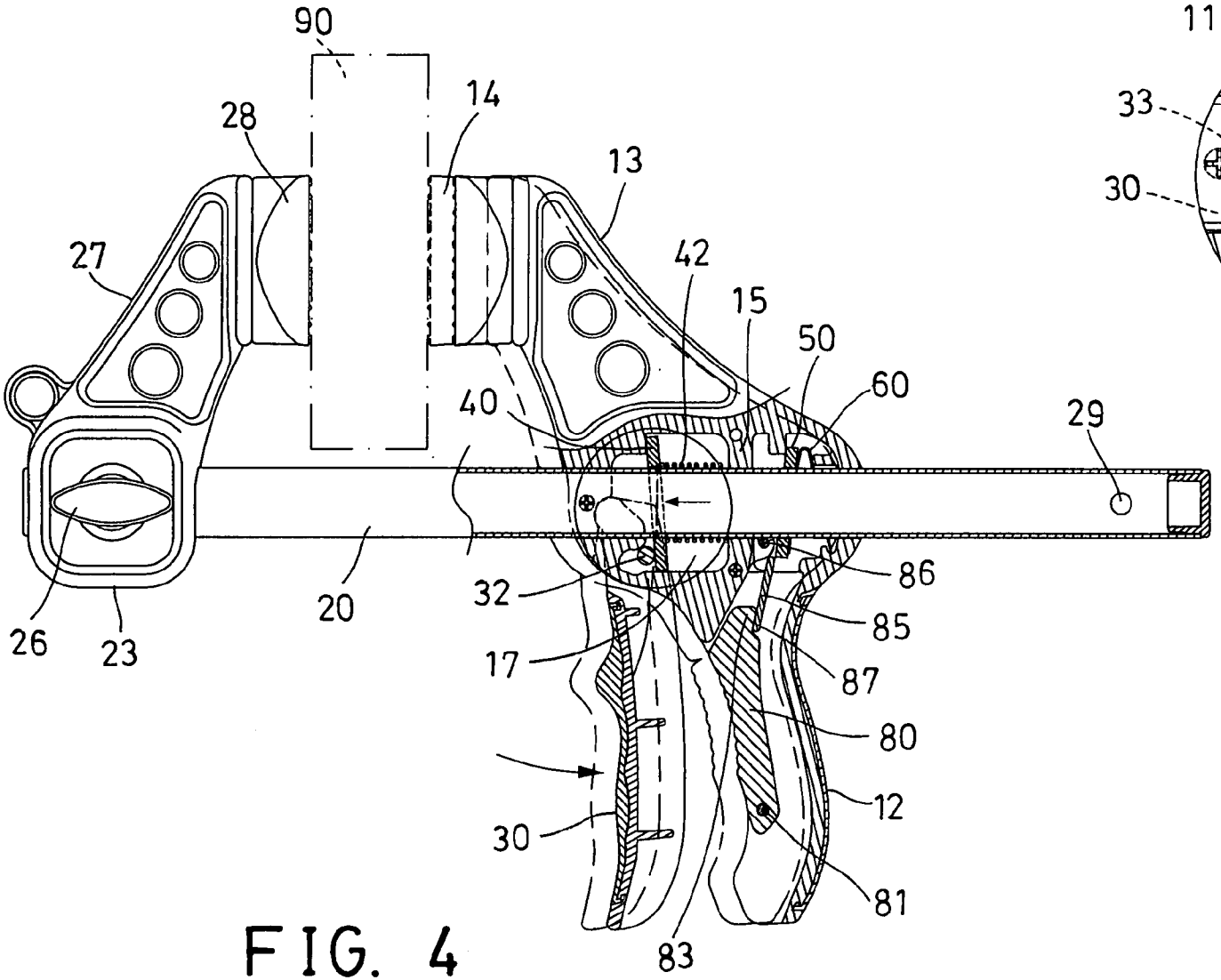
FIG. 4 is a partial cross sectional view similar to FIG. 3, illustrating the operation of the hand clamp.
Figure 6:
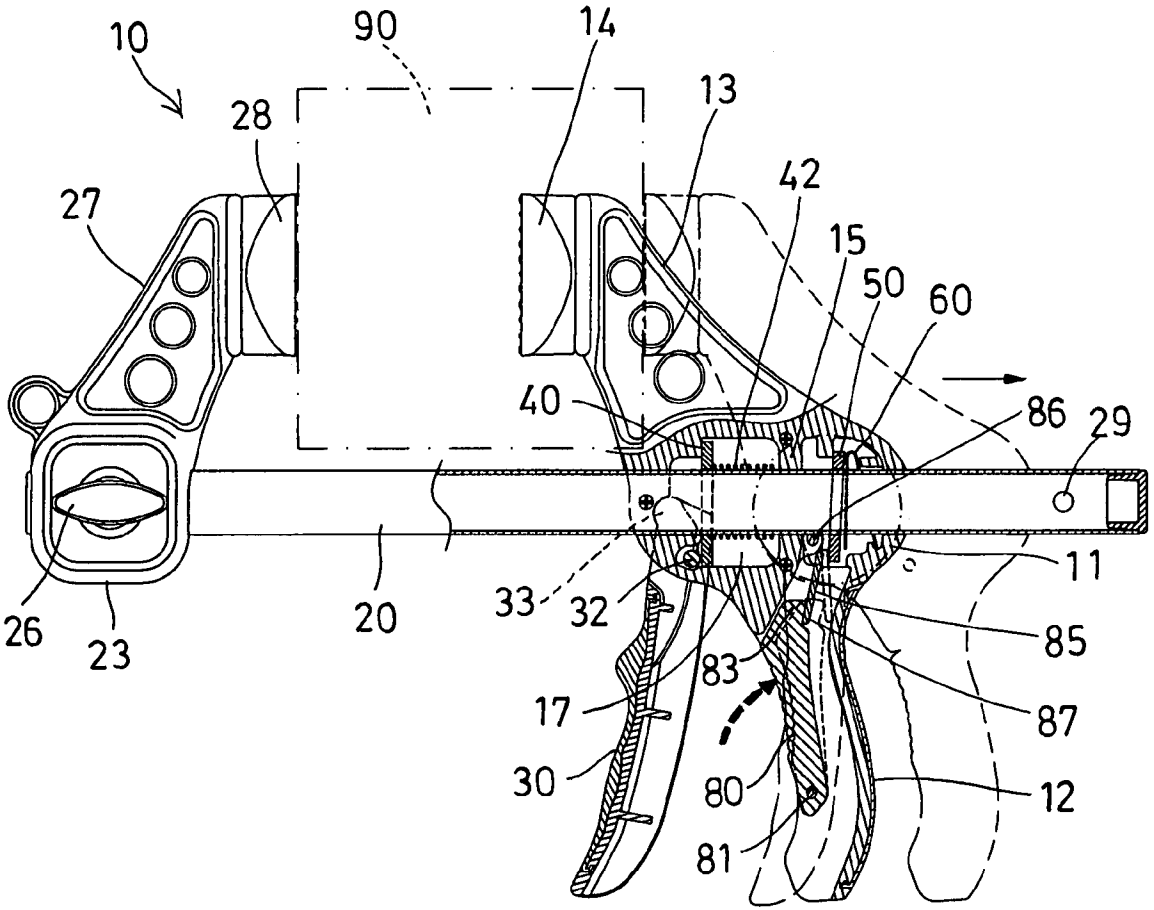
FIG. 6 is a further partial cross sectional view similar to FIGS. 3 and 4, illustrating the operation of the hand clamp.

A trigger 30 includes an aperture 31 formed in the middle or upper portion thereof for receiving a driving shaft 32 which is received in the front chamber 17 of the housing 11 (FIGS. 3, 4, 6), and includes a rounded upper end 33 extended into the front chamber 17 of the housing 11 and pivotally engaged with the housing 11 for pivotally or rotatably securing or attaching the trigger 30 to the housing 11, and for allowing the driving shaft 32 to be moved in concert with the trigger and to be moved forwardly and rearwardly relative to the housing 11 by the trigger 30 (FIGS. 3, 4, 6).

Figure 5:
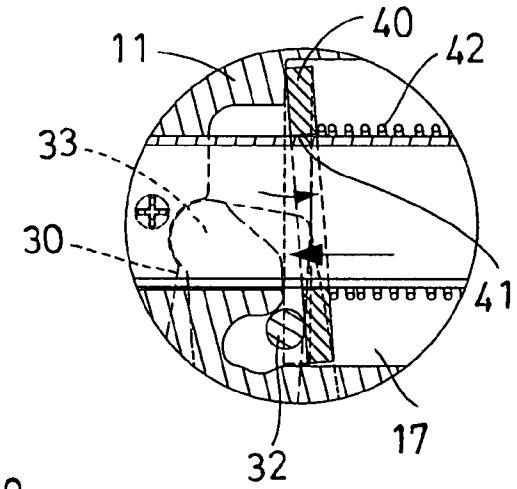
FIG. 5 is an enlarged partial cross sectional view of the hand clamp as shown in FIG. 4.

A driving lever 40 is received or engaged in the front chamber 17 of the housing 11 and includes an opening 41, such as a rectangular opening 41 formed therein and arranged for slidably receiving the piston rod 20 when the driving lever 40 is disposed perpendicular to the piston rod 20 (FIGS. 3, 6), and for selectively engaging or gripping the piston rod 20 when the driving lever 40 is tilted or slanted relative to the piston rod 20 (FIGS. 4, 5), and thus for allowing the piston rod 20 to be moved relative to the housing 11 by the trigger 30 and the driving shaft 32 step by step when the trigger 30 is cyclically pulled and released by the user.

A spring biasing means or member 42 is also received or engaged in the front chamber 17 of the housing 11 and disposed or engaged between the driving lever 40 and the partition 15 of the housing 11 for biasing or erecting the driving lever 40 relative to the partition 15 and for forcing the driving lever 40 to be arranged perpendicular to the piston rod 20 (FIGS. 3, 6), and thus for allowing the piston rod 20 to slide or to move relative to the driving lever 40. In operation, the piston rod 20 may be moved relative to the housing 11 step by step by moving the driving shaft 32 against the spring member 42 with the trigger 30, and the spring member 42 may then bias and erect the driving lever 40 relative to the partition 15 when the trigger 30 is released.

A braking lever 50 is received or engaged in the rear chamber 16 of the housing 11 and includes an opening 51, such as a rectangular opening 51 formed therein and arranged for slidably receiving the piston rod 20 when the braking lever 50 is disposed perpendicular to the piston rod 20, and for selectively engaging or gripping the piston rod 20 when the braking lever 50 is tilted or slanted relative to the piston rod 20 (FIGS. 3, 4, 6–7), and thus for allowing the piston rod 20 to be gripped or braked or anchored to the housing 11 when the braking lever 50 is tilted or slanted relative to the piston rod 20.

A spring biasing means or member 60 is also received or engaged in the rear chamber 16 of the housing 11 and includes an opening 61, such as a rectangular opening 61 formed therein for slidably receiving the piston rod 20, and the spring member 60 is disposed or engaged between the braking lever 50 and the housing 11 for biasing or tilting or slanting the braking lever 50 relative to the housing 11 and the piston rod 20, and for forcing the braking lever 50 to grip and brake and anchor the piston rod 20 to the housing 11 and to prevent the piston rod 20 from sliding or moving relative to the braking lever 50 and the housing 11. For example, as shown in FIGS. 1 and 7, the spring member 60 includes an anchoring blade 62 biased and engaged with the housing 11, and a biasing blade 63 engaged with the braking lever 50 for normally biasing or tilting or slanting the braking lever 50 relative to the housing 11.

Figure 7:
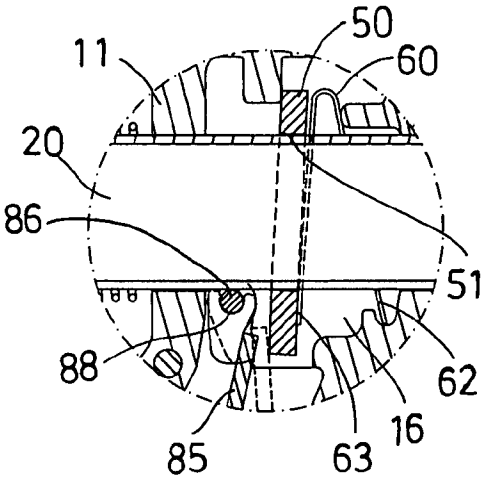
FIG. 7 is an enlarged partial cross sectional view of the hand clamp as shown in FIG. 6.

A hand grip 80 includes one end or lower end rotatably or pivotally coupled or secured to the housing 11 or the handle 12 with a pivot axle 81, for example, the housing 11 or the handle 12 includes a recess 82 formed therein (FIG. 1) for receiving the hand grip 80, and the recess 82 of the housing 11 or the handle 12 is communicating with the rear chamber 16 of the housing 11 for allowing another end or an upper actuating end 83 of the hand grip 80 to be provided for directly or indirectly actuating the braking lever 50, best shown in FIGS. 6 and 7, and to selectively erect the braking lever 50 to a position perpendicular to the piston rod 20 against the spring member 60. For example, the upper actuating end 83 of the hand grip 80 may be directly engaged with the braking lever 50 for selectively moving or erecting the braking lever 50 against the spring member 60.

Alternatively, as shown in FIGS. 1, 3, 6 and 7, an actuator 85 may further be provided and rotatably or pivotally attached or coupled to the housing 11 with a pivot pole 86 for allowing the actuator 85 to be rotated relative to the housing 11 and for allowing the actuator 85 to be moved to engage with the braking lever 50. For example, the actuator 85 may include the upper end pivotally attached or coupled to the housing 11 with the pivot pole 86, and may include a lower end 87 for engaging with the actuating end 83 of the hand grip 80 (FIGS. 3, 4, 6) and for allowing the actuating end 83 of the hand grip 80 to engage with or to actuate the actuator 85 to operate or to actuate the braking lever 50. For example, the housing 11 may include a curved recess 88 for rotatably or pivotally receiving and retaining the pivot pole 86.

In operation, as shown in FIGS. 3, 4, 6–7, the spring member 60 may bias or tilt or slant the braking lever 50 relative to the housing 11 and the piston rod 20 to force the braking lever 50 to grip and brake and anchor the piston rod 20 to the housing 11 and to prevent the piston rod 20 from sliding or moving backwardly relative to the braking lever 50 and the housing 11. The piston rod 20 may then be moved forwardly relative to the housing 11 by the trigger 30 and the driving shaft 32 step by step when the trigger 30 is cyclically pulled and released by the user.

When it is required to release the piston rod 20 from the housing 11, it is only required to depress or actuate the hand grip 80 in order to actuate or to force the actuating end 83 of the hand grip 80 to engage with the actuator 85 and to indirectly actuate the braking lever 50 via the actuator 85 (FIG. 7), and to selectively erect the braking lever 50 to a position perpendicular to the piston rod 20 and thus to allow the piston rod 20 to slide relative to the housing 11 and the braking lever 50. When the hand grip 80 is released by the user, the spring member 60 may bias or tilt or slant the braking lever 50 relative to the housing 11 and the piston rod 20 to force the braking lever 50 to grip and brake and anchor the piston rod 20 to the housing 11 again, and to prevent the piston rod 20 from sliding or moving relative to the braking lever 50 and the housing 11 again.

It is to be noted that the user may use his one hand to hold the handle 12, and use his four fingers to pull or actuate the trigger 30, and may then use one of his four fingers of the hand that holds the handle 12 to pull or actuate the hand grip 80 to force the actuating end 83 of the hand grip 80 to directly actuate the braking lever 50 or to indirectly actuate the braking lever 50 via the actuator 85, such that the hand clamp 10 may be easily operated with a single hand of the user.

Accordingly, the hand clamp in accordance with the present invention includes an auxiliary hand grip for actuating and releasing the braking lever and for allowing the hand clamp to be easily operated with a single hand of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand clamp comprising:

a housing including a downwardly extending handle for being held by a hand of a user, and including a channel formed in said housing, a piston rod slidably received in said channel of said housing and movable forwardly and rearwardly relative to said housing, a driving lever engaged in said housing and including an opening for slidably receiving said piston rod when said driving lever is perpendicular to said piston rod, and for selectively engaging and gripping said piston rod when said driving lever is tilted relative to said piston rod, a first biasing means for biasing said driving lever relative to said housing and for forcing said driving lever to be perpendicular to said piston rod, a trigger pivotally attached to said housing, a driving shaft attached to said trigger and moved in concert with said trigger, for being moved to engage with said driving lever and to tilt said driving lever relative to said piston rod against said first biasing means, and for allowing said piston rod to be moved relative to said housing by said trigger and said driving shaft step by step when said trigger is cyclically pulled and released by the user, a braking lever engaged in said housing and including an opening for slidably receiving said piston rod when said braking lever is perpendicular to said piston rod, and for selectively engaging and gripping said piston rod when said braking lever is tilted relative to said piston rod, a second biasing means for biasing said braking lever relative to said housing and for forcing and tilting said braking lever to grip and brake said piston rod to said housing and to prevent said piston rod from sliding relative to said braking lever and said housing, and a hand grip pivotally coupled to said handle, and including an actuating end for selectively forcing and erecting said braking lever against said second biasing means to a position perpendicular to said piston rod, and for selectively releasing said piston rod from said braking lever, and said trigger and said hand grip being operatable with the hand of the user that hold said handle of said housing.

2. The hand clamp as claimed in claim 1, wherein said housing includes a partition for separating a hollow interior of said housing into a rear chamber and a front chamber, said driving lever is received in said front chamber of said housing, and said braking lever is received in said rear chamber of said housing.

3. The hand clamp as claimed in claim 2, wherein said hand grip includes a lower end pivotally coupled to said handle with a pivot axle, and includes said actuating end provided on an upper portion for engaging with said braking lever.

4. The hand clamp as claimed in claim 3, wherein said handle includes a recess communicating with said rear chamber of said housing for receiving said hand grip.

5. The hand clamp as claimed in claim 2, wherein said housing includes at least one side cap attached to one side of said housing for enclosing said rear and said front chambers of said housing.

6. The hand clamp as claimed in claim 2, wherein said first biasing means includes a spring member received in said front chamber of said housing and engaged between said driving lever and said partition of said housing for biasing said driving lever relative to said housing.

7. The hand clamp as claimed in claim 2, wherein said second biasing means includes a spring member received in said rear chamber of said housing and engaged between said braking lever and said housing for biasing and tilting said braking lever relative to said housing.

8. The hand clamp as claimed in claim 7, wherein said spring member of said second biasing means includes an opening for slidably receiving said piston rod.

9. The hand clamp as claimed in claim 7, wherein said spring member of said second biasing means includes an anchoring blade engaged with said housing and a biasing blade engaged with said braking lever.

10. The hand clamp as claimed in claim 2, wherein said trigger includes a rounded upper end extended into said front chamber of said housing and pivotally engaged with said housing.

11. The hand clamp as claimed in claim 1, wherein said housing includes an upwardly extended fixed jaw for engaging with a work piece, and a gripping head attached to said fixed jaw for safely engaging with the work piece.

12. The hand clamp as claimed in claim 1, wherein said piston rod includes a follower attached onto said piston rod, follower includes a groove for receiving said piston rod and includes an orifice communicating with said groove of said follower for receiving a fastener, said fastener detachably secures said follower to said piston rod.

13. The hand clamp as claimed in claim 12, wherein said piston rod includes a front hole and a rear hole for selectively engaging with said fastener.

14. The hand clamp as claimed in claim 13, wherein a stop pin is selectively attached to either said front hole or said rear hole of said piston rod for engaging with said housing and for limiting said piston rod to slide relative to said housing and for preventing said piston rod from being disengaged from said housing.

15. The hand clamp as claimed in claim 12, wherein said follower includes a jaw member for engaging with a work piece, and a gripping head attached to said jaw member for safely engaging with the work piece.

16. The hand clamp as claimed in claim 1, wherein an actuator is pivotally attached to said housing with a pivot pole and rotatable relative to said housing for engaging and actuating said braking lever, and said actuating end of said hand grip is engaged with said actuator for indirectly actuating said braking lever via said actuator.

17. The hand clamp as claimed in claim 16, wherein said housing includes a curved recess for rotatably receiving and retaining said pivot pole.

* * * * *